US006598612B1

(12) United States Patent
Crowe

(10) Patent No.: US 6,598,612 B1
(45) Date of Patent: Jul. 29, 2003

(54) METHOD AND APPARATUS FOR IMPARTING A MANSARD SHAPE TO AN AWNING

(76) Inventor: James R. Crowe, P.O. Box 49294, Algood, TN (US) 38506

( * ) Notice: Subject to any disclaimer, the term of this patent is extended or adjusted under 35 U.S.C. 154(b) by 55 days.

(21) Appl. No.: 09/716,357

(22) Filed: Nov. 21, 2000

(51) Int. Cl.[7] ..... E04H 15/08; E04F 10/06

(52) U.S. Cl. ..... 135/88.12; 135/88.11; 296/163; 296/98; 160/67; 160/68

(58) Field of Search ..... 135/88.1, 88.11, 135/88.12; 52/74; 296/98, 163; 160/67, 68, 71, 80

(56) References Cited

U.S. PATENT DOCUMENTS

| | | | | |
|---|---|---|---|---|
| 1,222,907 A | | 4/1917 | Truemper | |
| 1,803,305 A | | 4/1931 | Sheard | |
| 2,880,795 A | * | 4/1959 | Macy et al. | 160/56 |
| 3,186,419 A | | 6/1965 | McCarroll | |
| 4,258,778 A | * | 3/1981 | Upton et al. | 160/383 |
| 4,727,897 A | * | 3/1988 | Watts | 135/88.1 |
| 4,848,386 A | | 7/1989 | Cooper | |
| 4,924,895 A | * | 5/1990 | Bailie | 135/88.12 |
| 5,171,056 A | | 12/1992 | Faludy et al. | |
| 5,203,393 A | | 4/1993 | Blevins et al. | |
| 5,335,960 A | | 8/1994 | Benignu, Jr. | |
| 5,369,850 A | * | 12/1994 | Noble | 135/88.12 |
| 5,449,032 A | | 9/1995 | Blevins et al. | |
| 5,531,239 A | | 7/1996 | Hannah, Jr. | |
| 5,860,440 A | | 1/1999 | Murray et al. | |
| 5,909,761 A | * | 6/1999 | Murray | 160/71 |
| 6,021,835 A | * | 2/2000 | Malott | 135/88.1 |
| 6,095,221 A | | 8/2000 | Frey, Jr. | |
| 6,260,908 B1 | * | 7/2001 | Fraula et al. | 135/88.12 |
| 6,260,909 B1 | * | 7/2001 | Crean et al. | 135/88.01 |

FOREIGN PATENT DOCUMENTS

| | | |
|---|---|---|
| GB | 1 488 351 | 10/1977 |

* cited by examiner

*Primary Examiner*—Lanna Mai
*Assistant Examiner*—Winnie Yip
(74) *Attorney, Agent, or Firm*—Harold Gell

(57) ABSTRACT

An easily deployed ridge pole is used, in combination with standard awning deployment hardware, to change the shape of the canopy fabric of an extended retractable awning. The ridge pole engages the underside of the awning fabric to impart a Mansard shape to the canopy. This shape incorporates first and second planes of canopy fabric wherein the plane closest to the RV has a less steep pitch than the plane furthest from the RV. The shape has airfoil qualities which stabilize the effects of high wind velocities on the awning. The shape also provides room under the relatively flat plane for doors under the awning to open without engaging the awning fabric. The ridge pole is supported by struts which in some embodiments provide foundations for fabric stabilizing clamps that are affixed to loose edges of canopy fabric.

18 Claims, 4 Drawing Sheets

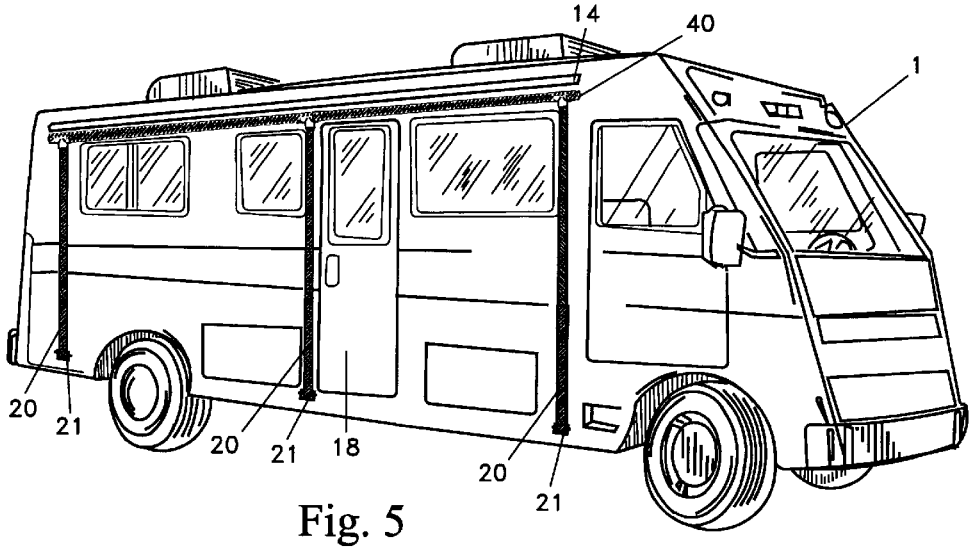
Fig. 5
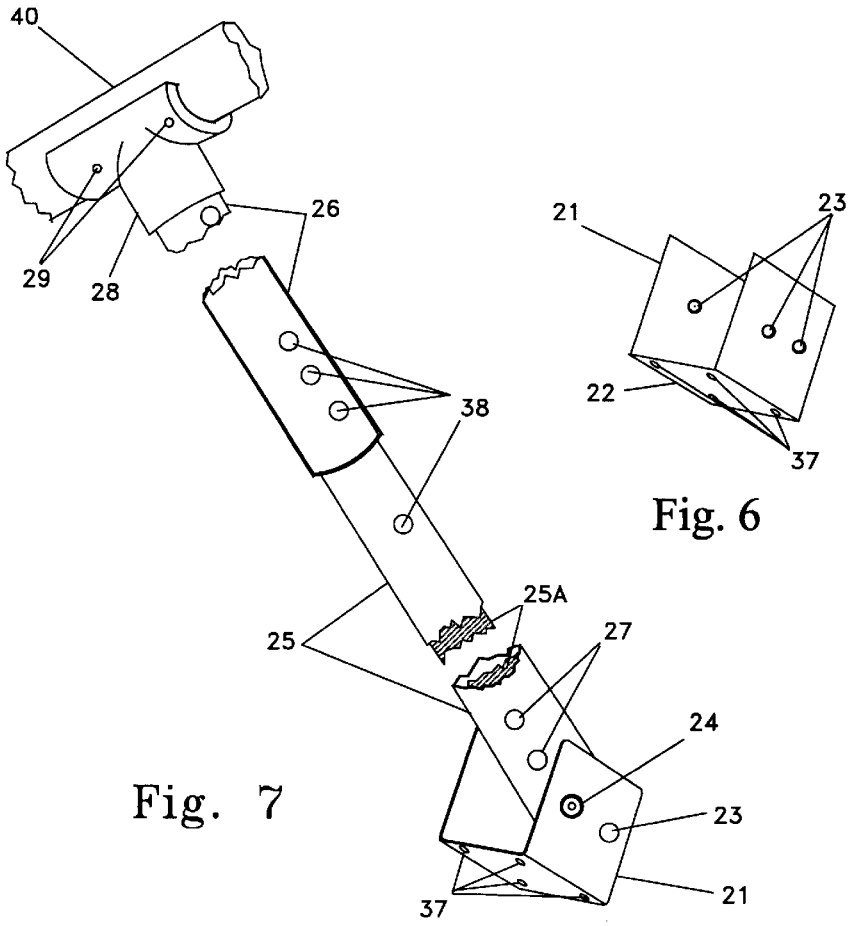
Fig. 6
Fig. 7

METHOD AND APPARATUS FOR IMPARTING A MANSARD SHAPE TO AN AWNING

BACKGROUND OF THE INVENTION

1. Field of the Invention

The present invention relates to a means for altering the shape of a deployed awning to provide under-the-awning protection from solar radiation when the sun is low on the horizon and clearance to open doors. The invention converts a deployed awning into an air foil which minimizes wind effects thereon and enables awning deployment in high wind situations.

2. Discussion of the Related Art

Retractable awnings are deployed from the sides of recreational vehicles, such as motor homes and mobile home trailers, to provide additional living space in the form of an outdoor area adjacent to the RV. Awnings of this type are typically retracted by rolling the canopy material onto a roller tube affixed to the free ends of struts pivotally mounted to the side of the RV. They provide shelter for the RV entrance to prevent rain or snow from entering the RV when the door is open. They are adjustable in pitch to provide a shaded, sheltered area forming an outdoor extension of living space for RV residents when the sun is low on the horizon.

Awnings currently in use provide extremely beneficial services, however, their shape when deployed often fails to provide the protection desired. For instance, when the sun is low on the horizon, the leading edge of the awning must be relatively close to the ground to provide shade. Because of the straight profile of the conventional single plane awning canopy from the RV structure to the awning leading edge, an awning with a low leading edge has a steep canopy or roof pitch which severely limits the usable area under the canopy. RV dimensions necessitate attaching the awning to the side of the structure close to the top of the door opening. Thus when the awning is configured with a steep pitch, it interferes with the door and prevents its opening or chafes against the upper comer of the open door and is thereby quickly destroyed. Furthermore, the large flat surface presented to the wind by awnings configured with a single plane canopy result in the awning fabric bellying up and down to further aggravate the contact between the awning fabric and the door upper edge. This "flapping" of the awning fabric creates excessive stress on the awning's deployment hardware and fittings and the noise created is excessive to the point where it is not only annoying but can cause damage to a person's auditory system.

Numerous attempts have been made to overcome problems with existing awnings but they have not proved successful or are only marginally so. For instance, various devices in the form of wheels and slides have been placed on the upper corner of doors. These devices are positioned to engage the underside of awnings and prevent the sharp corner of a door from tearing the fabric. Unfortunately, the constant rolling or sliding action of these devices against the fabric causes extreme wear of the awning canopy.

Other attempts to overcome the above problems have involved changes in awning configurations. One such attempt is the use of ribs installed on the underside of the awning fabric. T. Blevins, et al., U.S. Pat. No. 5,449,032 for "Awning Bow", issued Sep. 12, 1995 and U.S. Pat. No. 5,203,393 for "Awning Support Ribs", issued Apr. 20, 1993, are exemplary of the use of such devices to alter the shape of an awning. These devices successfully alter the shape of awnings, but the amount of curvature is limited so they do not overcome the problems associated with steep roof pitches and their installation is difficult as well as time-consuming and dangerous in high wind conditions.

OBJECTIVES OF THE INVENTION

A primary objective of the present invention is to provide a means to impart a Mansard shape to an awning to thereby provide clearance for opening doors and protection against winds and solar radiation when the sun is low on the horizon.

Another objective of the invention is to reshape a retractable RV awning whereby its canopy has two sections, one of which has a steeper pitch than the other to thereby provide clearance for opening doors and shade when the sun is low on the horizon.

A further objective is to provide an apparatus which is easily deployed and works with existing awnings to provide clearance for opening doors and shade when the sun is low on the horizon.

Another objective is to provide an apparatus which is easily deployed and works with existing awnings to reduce canopy wind resistance and thereby minimize fabric bellying.

A further objective is to create an air foil shape of an awning's fabric whereby wind induced flapping of the awning is minimized.

Another objective is to extend the life of awning fabrics by eliminating excessive wear caused by engagement with doors or other similar openings and flapping under high wind conditions.

A still further objective is to prevent excessive wear of awning deployment hardware caused by windy conditions.

Another objective is to provide an apparatus which is easily deployed and works with existing awnings to reduce wind induced fluttering of canopy edges.

A still further objective is to provide a ridge pole for altering the canopy shape of existing awnings and a support means therefor which includes means to stabilize the edges of the awning canopy.

SUMMARY OF THE INVENTION

According to the present invention, an easily deployed ridge pole is used, in combination with standard awning deployment hardware, to change the shape of the canopy fabric of an extended retractable awning. The ridge pole engages the underside of the awning fabric to impart a Mansard shape to the canopy. This shape incorporates first and second planes of canopy fabric wherein the plane closest to the RV, the first plane, has a less steep pitch than the plane furthest from the RV, the second plane. The shape has airfoil qualities which stabilize the effects of high wind velocities on the awning. The shape also provide room under the first, relatively flat plane for doors under the awning to open without engaging the awning fabric. The ridge pole is supported by struts which in some embodiments provide foundations for fabric stabilizing clamps that are affixed to loose edges of canopy fabric.

The ridge pole of the preferred embodiment is fabricated from plastic material having a smooth outer surface, such as PVC pipe. This reduces awning fabric ware. To accomplish its goals, the Mansard shape of the awning must be stable even under high wind loads. This necessitates a rigid ridge pole. The rigidity required of the ridge pole is attained by reinforcing the plastic pipe with a core. Preferably the core is a steel conduit which completely eliminates flexing of the ridge pole. This stabilizes the awning's canopy shape and eliminates wearing of the fabric against system components. In alternative embodiments the ridge pole may be fabricated from a material which is sufficiently rigid. Thus eliminating the need for a reinforcing core.

By forming a conventional awning into a Mansard shape, the invention creates room for doors under the awning canopy to open. An airfoil is also formed from the awning fabric. This stabilizes the awning in high wind conditions to minimize flapping and its attendant noise and the resultant wear of the awning and its fittings. The mechanics of the airfoil are inherent in a Mansard shape wherein the section of the awning canopy closest to the RV has a relatively flat pitch and the section of the canopy extending from the ridge pole to the leading edge of the awning has a relatively steep pitch. Thus wind flows up the steep pitch and is accelerated over the ridge pole and flat pitch area, creating a partial vacuum similar to that encountered by the high laminar flow over aircraft wings.

BRIEF DESCRIPTION OF THE DRAWINGS

FIG. 5 illustrates the invention stowed on the side of an RV.

FIG. 6 is a three-quarter view of an adjustable bracket used to secure the bottom of a ridge pole support to an RV.

FIG. 7 illustrates the details of an adjustable support for the ridge pole forming a part of the invention.

DESCRIPTION OF THE PREFERRED EMBODIMENT

Figure 1:
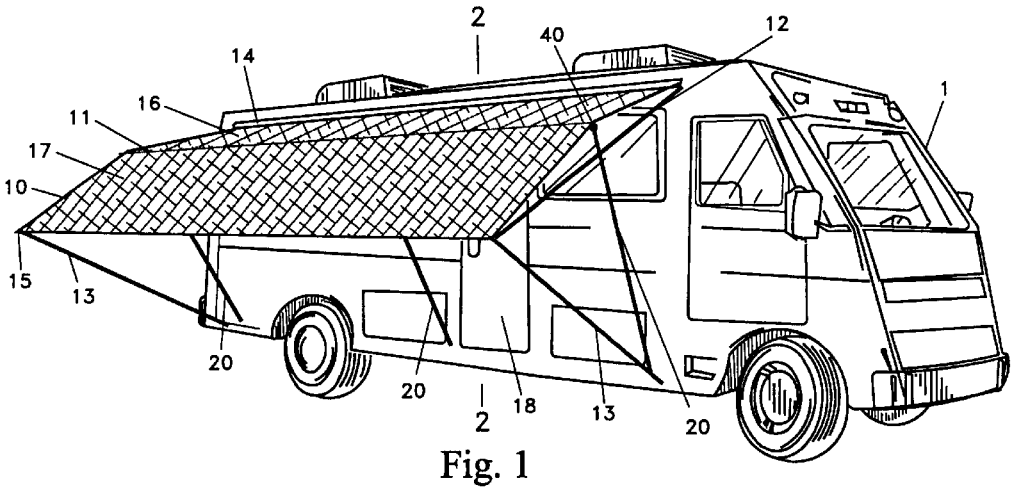
FIG. 1 depicts the effects of the preferred embodiment of the invention, i.e., a recreational vehicle with a deployed awning having a Mansard shape.

FIG. 1 illustrates a motor home with a deployed awning incorporating the primary embodiment of the invention and illustrating the fact that the invention changes the aerodynamic properties of the awning canopy 10. This is accomplished by applying an upward force to the underside of the canopy to create the ridge line 11 and thereby bifurcate the upper plane of the canopy. This action forms an upper plane 16 of awning canopy fabric between the "C" chanal 14, which holds the canopy fabric to the side of the RV and ridge line 11. It also forms a lower plane 17 of fabric which extends from the ridge line 11 to the end of the canopy which is attached to the boom 15. When the wind is flowing toward the awnings side of the motor home 1, the lower plane 17 functions as the leading edge of the airfoil which is completed by the upper plane 16 and the roof of motor home. If the wind is coming from the other side of the motor home, the aerodynamic properties of the planes and roof of the motor home are reversed. In either case, the airfoil effects minimize sudden pressure changes on the surface of the awning canopy and thereby minimizes flapping. Bifurcating the upper plane of the awning canopy reduces the area of common plane surfaces and thereby reduces bellying.

Thus the awning canopy, fabric 10, is formed over a ridge pole 40 causing a change in the plane of the fabric along the line 11 to create the classic Mansard shape of a two pitch roof comprised of a relatively flat plane adjacent to the side of the motor home 1 and a relatively steep plane running from the ridge pole line 11 to the fabric carrier roller tube, boom 15. For simplicity of explanation, the awning is deployed using one of numerous possible awning deployment hardware arrangements and the invention is not intended to be limited thereby. Accordingly, descriptions of the various attachment means used to couple the invention to an RV and its awning are exemplary in nature and are intended to be varied to accommodate specific applications. The arrangement chosen as exemplary includes side struts 12 and end supports 13. This configuration of support hardware normally provides a single plane awning shape for the fabric 10 as illustrated in FIG. 3. With the application of the invention, the ridge pole 40 and ridge pole supports 20 force the fabric 10 up along the ridge line 11 of FIG. 1. This may be seen more clearly by comparing the conventional awning shape illustrated in FIG. 3 with the Mansard shape created by the invention and illustrated in FIG. 2.

Figure 2:
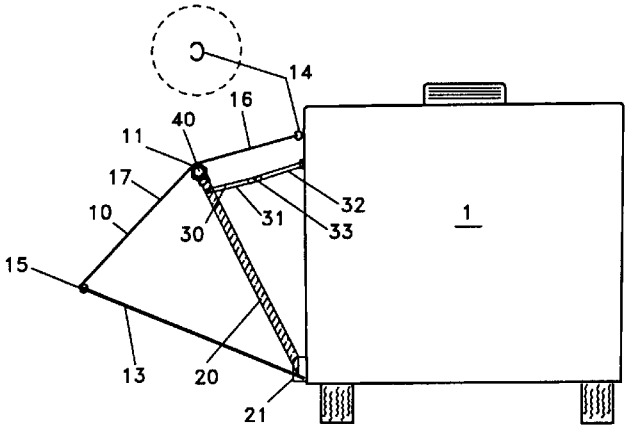
FIG. 2 is a cut away view of the motor home illustrated in FIG. 1 taken along the line 2—2 to more clearly illustrate the primary ridge pole support.
Figure 3:
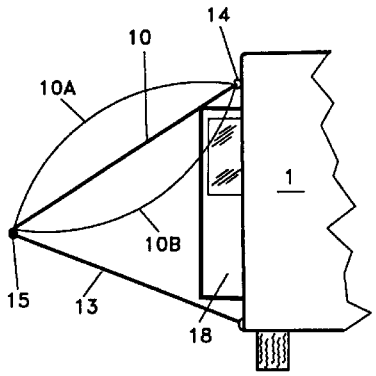
FIG. 3 is a view of a conventional awning deployed from the side of the motor home as illustrated in FIG. 2 without the invention in place.

In conventional RV retractable awnings, the fabric is provided with a bead along one edge which is slid into a "C" channel 14 which runs along upper section of the RV side, see FIGS. 1, 2 and 3 and note the enlarged cross-sectional view of the channel in FIG. 2. The awning fabric 10 is stored by rolling it onto a boom 15 which is in the form of a roller tube that contains a winding spring mechanism similar to that found in a conventional window shade. When the awning is deployed, the fabric 10 is unrolled from the boom 15 and held extended by struts 12 and end supports 13 which are secured between the awning boom 15 and the RV. In some instances, the end supports and struts are aided or replaced by poles and guy ropes or wires anchored to the ground. Whatever the case, the fabric 10 remains in a single plane as illustrated in FIG. 3. With the fabric in a single plane, the angle of the plane between the RV at the "C" channel 14 and the roller tube boom 15 becomes more acute as the leading edge of the awning is lowered to provide shade as the sun moves from its zenith towards the horizon. This brings the upper part of the fabric closer to the side of the RV and into a position where the RV door 18 cannot be fully opened without striking the fabric 10. The present invention avoids this problem as may be seen in FIG. 2 where the fabric 10 of the awning is divided between two planes with the upper section 16 being in a plane approaching perpendicular to the side of the RV to allow the door 18 room to open without striking the awning fabric 10. The lower section 17 of the awning from the ridge pole line 11 to the awning boom 15 is at an angle relative to the vertical sidewall of the structure from which the awning canopy is deployed (included angle) that is less than would be found with a conventional awning to provide adequate shade when the sun is low on the horizon.

Figure 9:
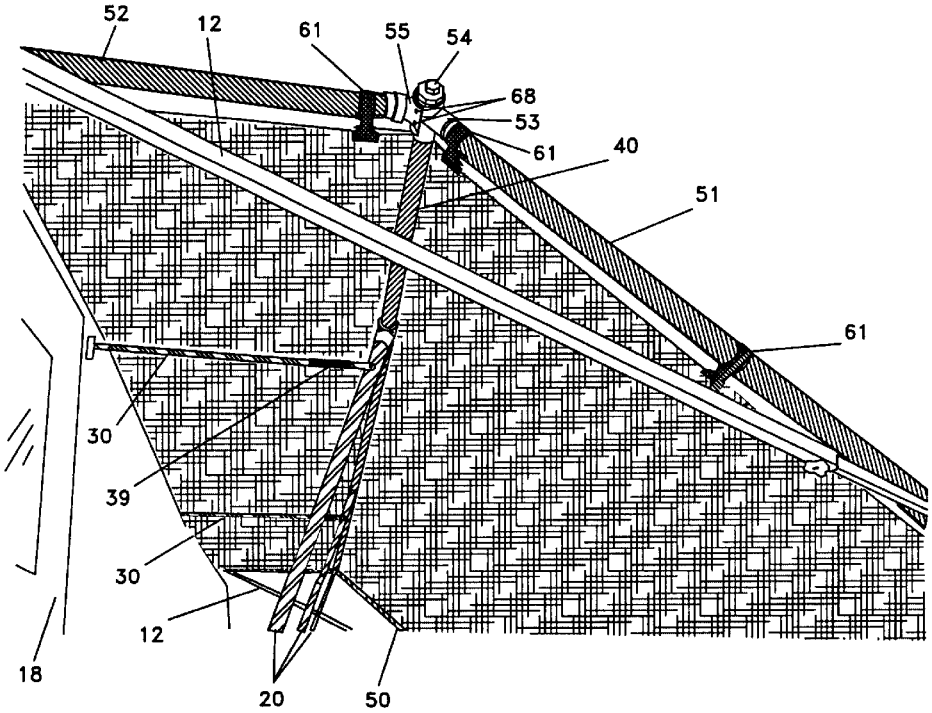
FIG. 9 is a view under an awning canopy illustrating the ridge pole, it supports and the fabric stabilization system of the invention.

The distance between the "C" channel 14 and the ridge line 11 and the angle between the plane of the upper section 16 and side of the RV are controlled by adjusting the length of the ridge pole supports 20 and support braces 30, see FIGS. 2 and 9. These adjustments permit the pitch of the upper plane 16 to be held constant for open-door clearance while changing the relative areas of the upper plane 16 and lower plane 17. In the preferred embodiment, the adjustments are made during the initial installation of the invention on an RV and so long as the apparatus remains with that particular RV, the settings need not be changed. For popular RV/awning combinations, the dimensions of the ridge pole supports 20 and support braces 30 may be predetermined and supplied as fixed length components, thus eliminating the need for this adjustment step during initial installation.

In the embodiment illustrated by FIG. 2, the support braces 30 are comprised of two members, 31 and 32, connected together by a hinge pin 33 and to the ridge pole support 20 and RV exterior wall by similar hinge pin devices or brackets. In an adjustable embodiment, hinge pin 33 is eliminated. Members 31 and 32 are interfitting tubular members that are adjustable in overall length by sliding the smaller diameter member into or out of the larger member in a fashioned similar to that illustrated for the ridge pole 20 in FIG. 7.

Installing the apparatus of the present invention into a retractable, adjustable awning system changes the aerodynamic properties of the awning canopy. For instance the ridge pole 40 is positioned on the underside of the awning canopy 10 parallel to the wall of the RV from which the awning canopy extends. This bifurcates the plane of the upper surface of the awning canopy by applying an upward pressure to its underside via the ridge pole. The deployment hardware of the awning is positioned so that the bifurcated plane results in first and second planes, 16 and 17 respectively, oriented at different angles relative to the original plane of the canopy. The first plane 16 comprises the section of awning canopy between the ridge pole and the RV and the second plane 17 extends from the ridge pole to the edge of the awning canopy opposite the edge connected to the RV. The ridge pole is positioned and maintained relative to the canopy so that the included angle of the second plane 17 relative to the vertical plane of the RV wall is less than the included angle of the first plane 16 relative to the vertical plane of the RV wall, see FIG. 2.

Without the improvements of the present invention, the single plane of fabric 10 is looser and subjected to a greater wind force. This causes bellying of the fabric 10 as seen in FIG. 3. In strong wind conditions, the fabric transitions between the convex shape 10A and concave shape 10B with booming reports that are not only annoying but also hazardous to a persons auditory system. With the present invention in-place, the large surface area of the awning canopy is divided into two relatively smaller surface area elements which, due to their smaller surface area, exhibit a significantly smaller amount of bellying than an awning without the invention installed.

Figure 4:
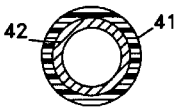
FIG. 4 is a sectional view of the ridge pole illustrating its steel core.

To ensure that the fabric of the awning is taught, the ridge pole 40 must not flex. In the preferred embodiment, the ridge pole is a PVC pipe, 41 of FIG. 4. This material is flexible and by its self not suitable. To overcome the flexibility problem, the preferred embodiment incorporates a steel core 42 within the PVC pipe 41. This core may be of any ridged material but in the best mode of the invention it is a metal conduit dimensioned to fit snugly within the PVC pipe to eliminate relative motion between the PVC pipe 41 and its core 42. This technique may also be used to stiffen the ridge pole supports 20 as illustrated in FIG. 7 were the tubular section 25 is provided with a rigidized core 25A. If desired, the ridge pole 40 or ridge pole supports 20 may be constructed from material which is sufficiently rigid to eliminate the need for reinforcing cores.

FIG. 5 illustrates a motor home with the awning assembly removed to more clearly illustrate the components of the primary embodiment of the invention in their stowed positions. The ridge pole 40 is held flush against the side of the RV as are the ridge pole supports 20. Hinge brackets 21 support the ridge pole supports 20 when they are in the stowed position as illustrated in FIG. 5 or deployed as in FIGS. 1 and 2. The similar brackets are used to secure the support braces 30 to the RV. The hinge brackets 21 are "U" shaped in the preferred embodiment as illustrated in FIG. 6 but they may be conventional "L" brackets. The base of the "U" includes a plurality of holes 37 through which the bracket is fastened to the RV 1 exterior wall by screws, bolts or rivets. The sidewalls of the bracket include a plurality of holes which are used selectively to fasten the ridge pole support 20 to the RV. The relative length of the ridge pole supports 20 may be adjusted slightly by using different holes 23 in combination with different holes 27 through the ridge pole support. This provides only a small amount of length variability. In the fully adjustable, i.e. universal, embodiment, the ridge pole supports 20 are as illustrated in FIG. 7 wherein each ridge pole support is comprised of a based section 25 and a larger diameter upper section 26. These sections are tubular and dimensioned so that one section slides within the other. A plurality of holes 37 are provided in both sections to provide a means to lock the sections together by sliding a pin or similar object through aligned holes when the support is adjusted to the required length. The upper section 26 is terminated by a fitting 28 which cradles the ridge pole 40 but does not extend around the ridge pole where it could contact the fabric 10 of the awning. This construction technique is used to avoid excessive wear spots on the canopy. If the ridge pole is metal, this connection may be a weldment but in the preferred embodiment, a PVC tee is altered by removing a section as illustrated in FIG. 7. The modified tee is secured to the ridge pole by screws 29, rivets or other fastening means. Base member 25 is secured in the bracket 21 by a hinge pin 24 which passes through holes 23 in the opposing sides of the bracket.

Figure 8:
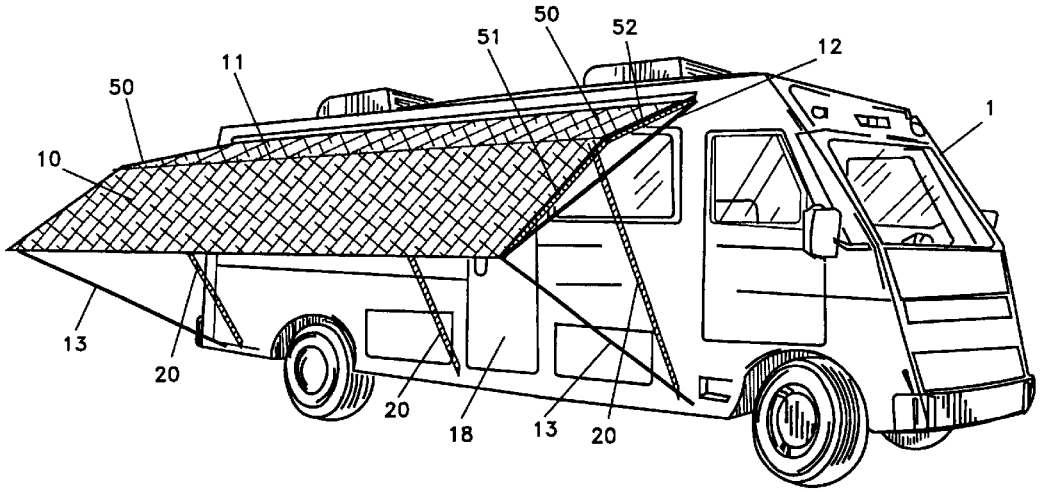
FIG. 8 illustrates a deployed awning enhanced by the invention with an ancillary fabric stabilization system.
Figure 11:
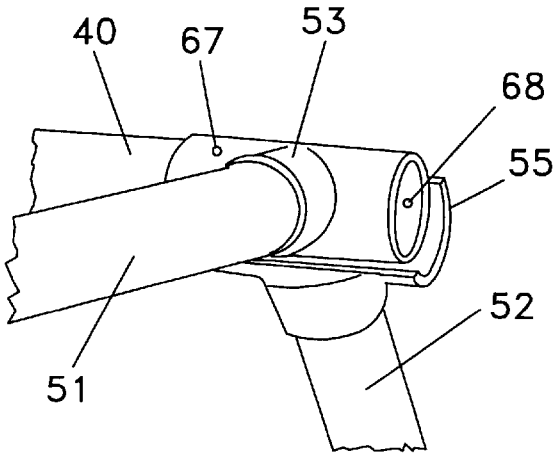
FIG. 11 is a detailed view of the support members of the fabric stabilization system attached to the end of the ridge pole.

In a further embodiment of the invention, end support stabilizing struts are provided for the ridge pole 40 and awning canopy. These supports, 50 of FIG. 8, are arranged parallel to the side edges of the awning fabric 10 and provide a means to secure fabric stabilization clamps 61 as illustrated in FIG. 9. In the preferred embodiment of this form of the invention, each side edge of the canopy is provided with a support assembly 50 comprised of a lower stabilizing strut 51 and an upper stabilizing strut 52. Stabilizing struts 51 and 52 may be of a fixed length but preferably they are of variable length and are constructed of intermitting cylindrical members wherein a smaller diameter tube slides into a larger diameter tube as in the ridge pole support illustrated in FIG. 7. The large and small diameter tubes are locked at a desired length by pins as described for the ridge pole supports. The lower stabilizing strut 51 is secured to the end of the ridge pole 40 by a tee 53 which is securely fasten as a termination of the lower stabilizing strut 51, see FIG. 9. The ridge pole 40 slides into the tee 53 and is secured thereto by screws, nuts and bolts, pins or similar removable hardware 67. This arrangement allows the strut 51 to be rotated relative to the ridge pole 40 and aligned to the Mansard profile of the awning during initial installation. The threaded cap 54 prevents rain from entering the bore of the ridge pole. The upper stabilizing strut 52 is connected to the tee 53 by a modified tee 55. This modified tee 55 is similar to the modified tee 28 which connects the ridge pole support to the ridge pole. The modified tee 55 is secured to tee 53 by screws, nuts and bolts, pins or similar removable hardware 68. The ridge pole 40 and tee 53 are held tightly into the saddle created by the modification of tee 55 by forces applied to the ridge pole 40 and the securing hardware 68. The modification of tee 55 is the removal of a significant portion of the cross member portion of the tee as best seen in FIG. 11 and with respect to the similar modification to tee 28, FIG. 7.

Figure 10:
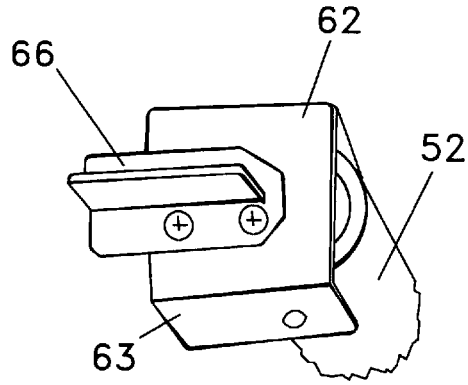
FIG. 10 is a stylized view of the hardware attachment for connecting a strut of the fabric stabilization to the RV.

When the awning is deployed, the ridge pole supports 20 and support braces 30 hold the ridge pole so that tee 53 is securely pressed against and into the saddle of tee 55. The other end of the upper stabilizing strut 52, which is terminated by tee 55 at the ridge pole end is held in position against the side of the RV by a keyed bracket 62 such as illustrated in FIG. 10. This bracket is comprised of a "U" shaped member 63 similar to the ridge pole support brackets 21 illustrated in FIGS. 6 and 7. However, instead of a plurality of holes permitting the fastening of the "U" shaped bracket to the side of the RV by screws or rivets, member 63 has a keel 66 secured to it. The keel 66 is dimensioned to fit into the "C" channel 14 which runs the length of the RV, see FIG. 5. A screw or pin may be placed through the "C" channel after the support member 63 is installed to prevent it from sliding out.

Figure 12:
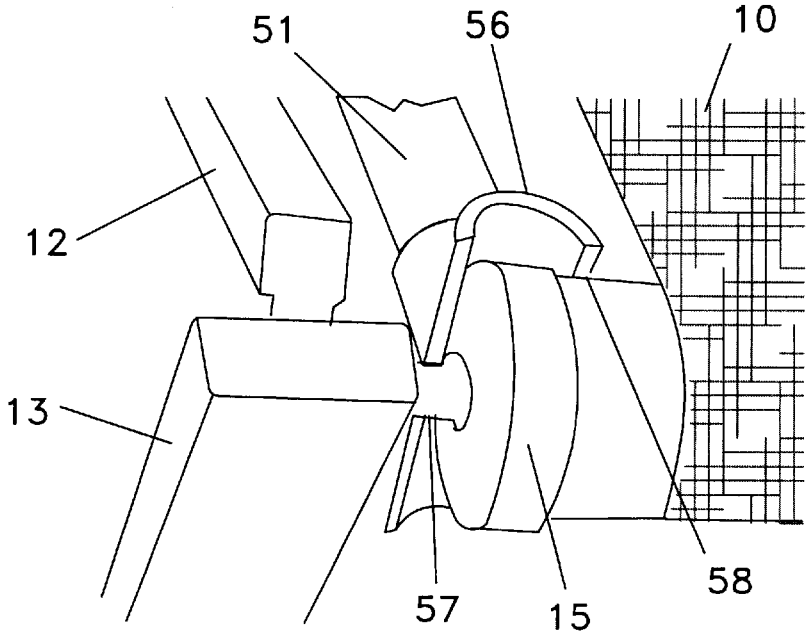
FIG. 12 is a detailed view of the shoe which connects the out-board strut of the fabric stabilization system to the fabric carrier end boom of the awning deployment mechanism.

The end of the lower stabilizing strut 51 that is opposite tee termination 53 is provided with a modified tee 56 which creates a saddle that fits over the hub of the roller tube of the awning boom 15, see FIG. 12. This modified tee is similar to modified tees 28 and 55 in that the upper half of the tee's cross member is removed. The remaining portion of the tee is further modified by the creation of a crescent to opening 58 on the opposite side of the modified cross portion of the tee to accommodate the awning boom 15.

Whenever a support brace 30 is positioned so that an open door 18 may strike it, a sleeve 39 of rubber or other soft material is positioned to cover the point on the brace 30 which would be contacted by the open door.

What is claimed is:

1. An apparatus for changing the aerodynamic properties of an awning canopy, comprising:

a ridge pole comprised of an outer structure for presenting a smooth surface to the underside of said awning canopy and a rigid inner core for preventing flexing of said ridge pole;

a ridge pole support means for holding said ridge pole against the underside of said awning canopy after said awning canopy is deployed whereby the upper surface of said awning canopy is forced into a Mansard shape comprising an upper slope and a lower slope steeper than said upper slope;

an upper plane stabilizing strut positioned parallel to a side edge of said awning canopy and extending from the sidewall of the structure from which said awning canopy is deployed to the end of said ridge pole;

a lower plane stabilizing strut positioned parallel to a side edge of said awning canopy and extending from said ridge pole to the edge of said awning canopy furthest from the sidewall of the structure from which said awning canopy is deployed; and means for securing an end of said upper plane stabilizing strut and said lower plane stabilizing strut to a common end of said ridge pole.

2. An apparatus for changing the aerodynamic properties of an awning canopy as defined by claim 1, wherein said ridge pole support means comprises:

at least one support pole including a ridge pole engaging end and a based end;

a bracket connecting said base end to the side of the structure from which said awning canopy is deployed;

means for securing said base end in said bracket whereby said support pole may be rotated from a storage position against the sidewall of the structure from which said awning canopy is deployed to an awning canopy engaging position.

3. An apparatus for changing the aerodynamic properties of an awning canopy as defined by claim 2, wherein said means for securing said base end in said bracket includes a plurality of securing positions whereby the effective length of said support pole between said awning canopy and the sidewall of the structure from which said awning canopy is deployed may be adjusted.

4. An apparatus for changing the aerodynamic properties of an awning canopy as defined by claim 2, wherein said support pole is comprised of first and second sections and means to connect said first and second sections together with varying amounts of overlap whereby the effective length of said support pole between said awning canopy and the sidewall of the structure from which said awning canopy is deployed may be adjusted.

5. An apparatus for changing the aerodynamic properties of an awning canopy as defined by claim 2, comprising a brace for holding said ridge pole engaging end of said support pole a predetermined distance from the sidewall of the structure from which said awning canopy is deployed.

6. An apparatus for changing the aerodynamic properties of an awning canopy as defined by claim 5, comprising means for adjusting the length of said brace whereby said predetermined distance of said ridge pole engaging end of said support pole from the sidewall of the structure from which said awning canopy is deployed may be adjusted.

7. An apparatus for changing the aerodynamic properties of an awning canopy as defined by claim 1, comprising means for securing said edge of said awning canopy to said upper plane stabilizing strut and said lower plane stabilizing strut.

8. An apparatus for changing the aerodynamic properties of an awning canopy as amended defined by claim 7, comprising means for adjusting the length of said lower plane stabilizing strut.

9. An apparatus for changing the aerodynamic properties of an awning canopy as defined by claim 7, comprising means for adjusting the length of said upper plane stabilizing strut.

10. An apparatus for changing the aerodynamic properties of an awning canopy of the type which has a secured edge and a leading edge and which is stored in a rolled configuration and deployed by pulling said leading edge from a storage means, comprising:

a ridge pole;

a ridge pole support means for holding said ridge pole against the underside of said awning canopy after said awning canopy is deployed whereby the plane of the upper surface of said awning canopy is bifurcated into an upper plane extending from said storage means to said ridge pole and a lower plane extending from said ridge pole to said leading edge;

means comprising an upper plane stabilizing strut positioned parallel to a side edge of said awning canopy and extending from the sidewall of the structure from which said awning canopy is deployed to the end of said ridge pole for positioning said ridge pole support means and thereby adjusting the relative areas of said upper and lower planes while maintaining the pitch of said upper plane constant;

a lower plane stabilizing strut positioned parallel to a side edge of said awning canopy and extending from said ridge pole to the edge of said awning canopy furthest from the sidewall of the structure from which said awning canopy is deployed; and means for securing an end of said upper plane stabilizing strut and said lower plane stabilizing strut to a common end of said ridge pole.

11. An apparatus for changing the aerodynamic properties of an awning canopy as defined by claim 10, wherein said ridge pole support means comprises:

at least one support pole including a ridge pole engaging end and a based end;

a bracket connecting said base end to the side of the structure from which said awning canopy is deployed;

means for securing said base end in said bracket whereby said support pole may be rotated from a storage position against the sidewall of the structure from which said awning canopy is deployed to an awning canopy engaging position.

12. An apparatus for changing the aerodynamic properties of an awning canopy as defined by claim 11, wherein said means for adjusting the relative areas of said upper and lower planes while maintaining the pitch of said upper plane constant comprises a plurality of securing positions of said bracket and said support pole whereby the effective length of said ridge pole support means between said awning canopy and the sidewall of the structure from which said awning canopy is deployed is adjusted.

13. An apparatus for changing the aerodynamic properties of an awning canopy as defined by claim 11, wherein:

said support pole is comprised of first and second sections; and said means for adjusting the relative areas of said upper and lower planes while maintaining the pitch of said upper plane constant comprises means to connect said first and second sections together with varying amounts of overlap whereby the effective length of said support pole between said awning canopy and the sidewall of the structure from which said awning canopy is deployed is adjusted.

14. An apparatus for changing the aerodynamic properties of an awning canopy as defined by claim 11, wherein said ridge pole support means comprises a brace for holding said ridge pole engaging end of said support pole a predetermined distance from the sidewall of the structure from which said awning canopy is deployed.

15. An apparatus for changing the aerodynamic properties of an awning canopy as defined by claim 14, comprising means for adjusting the length of said brace whereby said predetermined distance of said ridge pole engaging end of said support pole from the sidewall of the structure from which said awning canopy is deployed may be adjusted.

16. An apparatus for changing the aerodynamic properties of an awning canopy as defined by claim 10, comprising means for securing said edge of said awning canopy to said upper plane stabilizing strut and said lower plane stabilizing strut.

17. An apparatus for changing the aerodynamic properties of an awning canopy as defined by claim 16, comprising means for adjusting the length of said lower plane stabilizing strut.

18. A method for changing the aerodynamic properties of an awning canopy, including the steps of:

positioning a ridge pole on the underside of said awning canopy parallel to the wall of the structure from which said awning canopy extends;

bifurcating the plane of the upper surface of said awning canopy by applying an upward pressure to the underside of said awning canopy via said ridge pole;

maintaining the deployment hardware of said awning canopy whereby said bifurcated plane results in first and second planes oriented at different angles wherein said first plane comprises the section of awning canopy between said ridge pole and the structure from which said awning canopy extends and said second plane extends from said ridge pole to the edge of said awning canopy opposite the edge connected to the wall of the structure from which said awning canopy extends;

maintaining the position of said ridge pole via a brace and stabilizing struts extending from the wall of the structure from which said awning canopy extends such that the included angle of said second plane relative to the vertical is less than the included angle of said first plane relative to the vertical;

positioning an upper plane stabilizing strut of said stabilizing struts parallel to a side edge of said awning canopy extending from the sidewall of the structure from which said awning canopy is deployed to the end of said ridge pole;

positioning a lower plane stabilizing strut of said stabilizing struts parallel to a side edge of said awning canopy extending from said ridge pole to the edge of said awning canopy furthest from the sidewall of the structure from which said awning canopy is deployed; and securing an end of said upper plane stabilizing strut and said lower plane stabilizing strut to a common end of said ridge pole.

* * * * *